United States Patent [19]

Willa

[11] Patent Number: 5,070,660

[45] Date of Patent: Dec. 10, 1991

[54] SNOW GUARD

[76] Inventor: Siegfried Willa, Bahnhofstrasse 4, 3900 Brig, Switzerland

[21] Appl. No.: 457,314

[22] Filed: Dec. 26, 1989

[30] Foreign Application Priority Data

Dec. 29, 1988 [CH] Switzerland ..... 4846/88
Sep. 21, 1989 [CH] Switzerland ..... 3434/89

[51] Int. Cl.[5] ..... B61D 17/12
[52] U.S. Cl. ..... 52/24; 52/25
[58] Field of Search ..... 52/24–26

[56] References Cited

U.S. PATENT DOCUMENTS 1,570,222 1/1926 Barley ..... 52/24 X
3,289,361 12/1966 Holliday ..... 52/24

FOREIGN PATENT DOCUMENTS 255102 6/1967 Austria ..... 52/24
3303306 9/1983 Fed. Rep. of Germany ..... 52/24
2554850 5/1985 France ..... 52/24
47692 3/1930 Norway ..... 52/25
462431 10/1968 Switzerland ..... 52/24
626937 12/1981 Switzerland ..... 52/24

*Primary Examiner*—Gary L. Smith
*Assistant Examiner*—Suzanne L. Dino
*Attorney, Agent, or Firm*—Arnold, White & Durkee

[57] ABSTRACT

A snow guard is described which includes an integrated plastic part with a snow retaining part, as well as a bearing part and a retaining strap that can be moved and secured in the integrated plastic part. A shoulder connected to the snow retaining part, as well as the horizontal part and a projection of the retaining strap, form two arms that engage the lower end of a roof tile in the manner of prongs. The upper area of the vertical part of the strap is provided with a nose, and a spring surrounds the upper area of the vertical part of the strap and the nose. A catch plate with catch teeth is provided in the integrated plastic part parallel to the vertical part of the retaining strap. To assemble the snow guard, the retaining strap is inserted into a guide channel arranged in a vertical guide part, and a spring engages between two catch teeth. The snow guard can be used for roof tiles of any shape and thickness.

20 Claims, 5 Drawing Sheets

SNOW GUARD

BACKGROUND OF THE INVENTION

Known snow guards have the disadvantage that a different type of snow guard must be used for each different type and thickness of roof tile.

For example, Swiss Patent 533,216 describes a snow-collecting device on a sloping roof covered with roofing sheets. However, this snow guard is not suitable for all shapes and thicknesses of roof tiles. Moreover, this snow guard must be made of a relatively thick material in order to hold the great loads of snow required. This causes the tile above it to be raised. Moreover, a snow guard according to the aforementioned publication where is must be made of a relatively thick material cannot be applied over a profiled roof tile because this snow guard has too little elasticity.

SUMMARY OF THE INVENTION

Therefore, the purpose of the present invention is to create a snow guard that will avoid the above-mentioned disadvantages and can be used for any shapes and thicknesses of roof tile. This is achieved according to this invention by the characterizing features of independent patent claims 1, 5, and 11.

Known snow guards are mounted on the upper end of the roof tile. This makes it possible for water to splash between two tiles and thus enter the roof. One advantage of the snow guard according to this invention is that it is mounted on the lower end of a roof tile, which prevents water from splashing into the roof.

Known snow guards mounted on the upper end of the roof tile also have the disadvantage that when the roofer is standing on the snow retaining part, the snow guard can tilt over and lift the upper tile. This disadvantage cannot occur with the snow guard according to this invention.

When using sliding tiles in the past, it has been necessary to make the snow guards shorter or longer because they were suspended at the upper end of the tile. The snow guard according to this invention can be used with sliding tiles in any position of the latter.

Known snow guards have the disadvantage that they tilt over when stepped on, so they raise the tile, slip away from the tile, and thus can cause accidents. The snow guard according to this invention insures a secure grip when walking on the roof.

Another advantage of the snow guard according to this invention is that the snow load is better distributed than with known snow guards so the snow load is mostly located directly above a roof crossbeam. This increases the lifetime of the roof tiles.

An additional advantage of the snow guard according to this invention is the small contact area of the snow guard with the roof tiles so the tiles can dry out better and more rapidly after either rain or snow, and in contrast with known snow guards, the glaze and clay compound of the tile cannot deteriorate and make the tile water permeable.

BRIEF DESCRIPTION OF THE DRAWINGS

Practical examples of this invention as well as their use are explained in greater detail on the basis of the accompanying figures which show the following.

DESCRIPTION OF THE PREFERRED EMBODIMENTS

Figure 1:
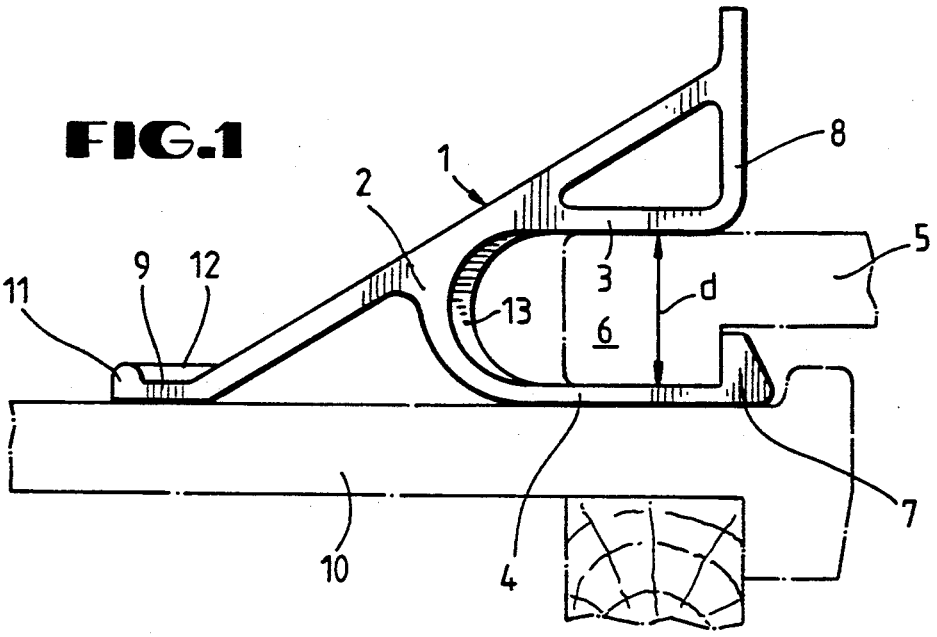
FIG. 1 shows a side view of a first practical example of the snow guard.

Snow guard 1 according to FIG. 1 has a middle part 2 connected to two side arms 3 and 4 which surround the lower end of tile 5. Tile 5 has a shoulder 6 on its lower end around which a projection 7 of the lower side arm 4 reaches. Side arms 3 and 4 reach around the lower end of roof tile 5 in the manner of tongs. The upper side arm 3 rests on the upper surface of tile 5 and is bent at a right angle at the end. Part 8 with the right angle bend forms the actual snow retaining part. On the opposite end from snow retaining part 8, middle part 2 has a contact part 9 for resting on lower tile 10. The two side arms 3 and 4 are flexible so the thickness d of shoulder 6 of tile 5, as well as its shape, may vary. Snow guard 1 is held on upper tile 5 by projection 7 so it cannot slip down the roof. Contact part 9 also has a projecting part 11 and a reinforcing rib 12. Reinforcing rib 13 is provided between the two side arms 3 and 4. One advantage of the arrangement of the snow guard on the lower end of the roof tile is that water that collects on snow retaining part 8 cannot reach the upper end of the tile where it might be able to penetrate into the interior of the roof. The snow guard is preferably made of metal but may also be made of plastic.

Figure 2:
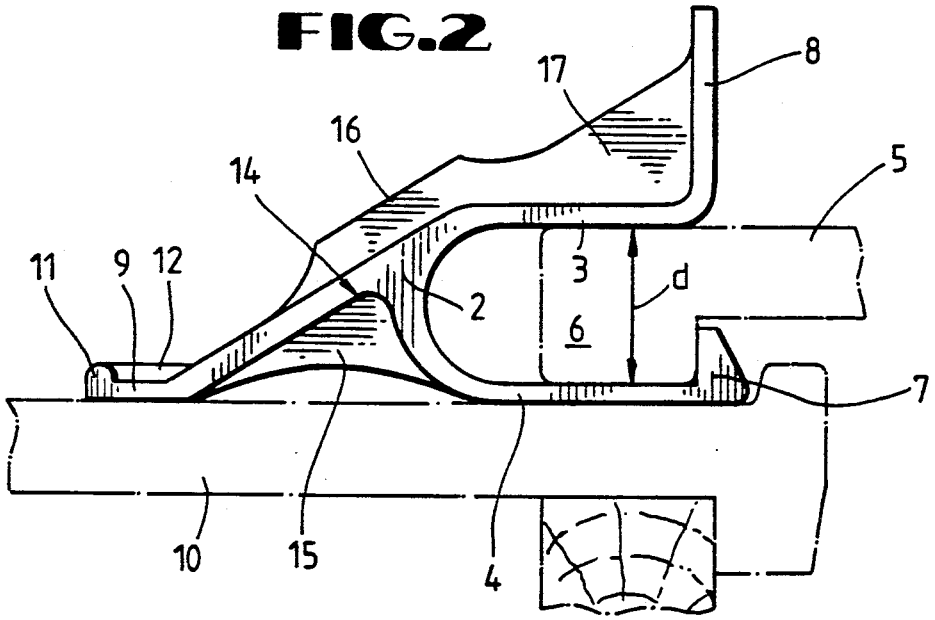
FIG. 2 shows a side view of a second practical example of the snow guard.

Snow guard 14 according to FIG. 2 has a structure similar to that illustrated in FIG. 1 but it is provided with additional reinforcing ribs 15, 16, and 17.

Figure 3:
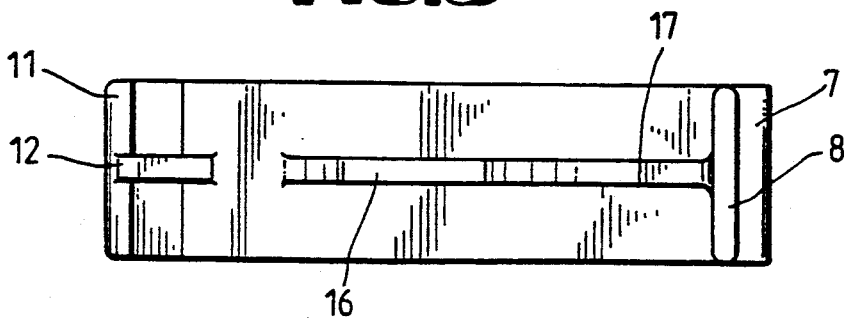
FIG. 3 shows a top view of the snow guard according to FIG. 2.

FIG. 3 shows a top view of the snow guard according to FIG. 2.

Figure 4:
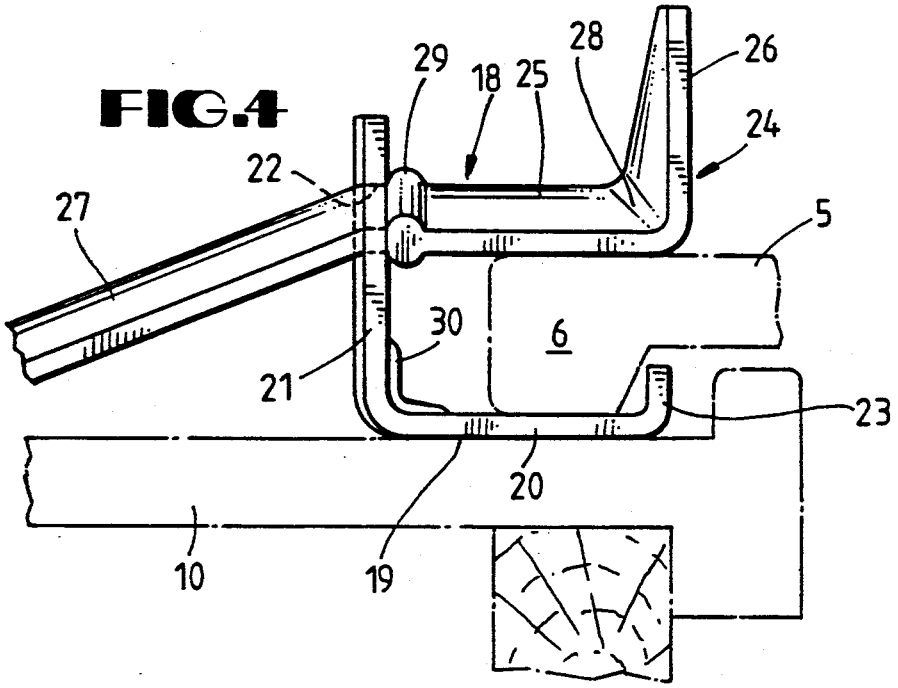
FIG. 4 shows a side view of a third version of the snow guard.

FIG. 4 shows a third practical example of a snow guard 18 as seen in a side view. Snow guard 18 includes a retaining strap 19 that is made of metal and is bent twice. This retaining strap has a part 20 that rests on the surface of roof tile 10, a part 21 at right angles to the latter with an opening 22 and a projection 23 on part 20 with which snow guard 18 is secured against slipping so the projection rests on shoulder 6 of roof tile 5. A part 24 with several bends passes through opening 22 in part 21 of the retaining strap. Part 24 has a part 25 that rests on the surface of roof tile 5 and also has a snow retaining part 26 projecting at right angles to the latter as well as a part 27 running obliquely to part 25. Part 24 has a reinforcing rib 28 over its entire extent. In the area where part 24 passes through opening 22 in retaining strap 19, there is a stop rib 29 so part 24 cannot slip entirely through opening 22 as far as part 26. This version of the snow guard can also be used for roof tiles of different shapes and thicknesses. Part 24 is made of fiberglass reinforced plastic.

Figure 5:
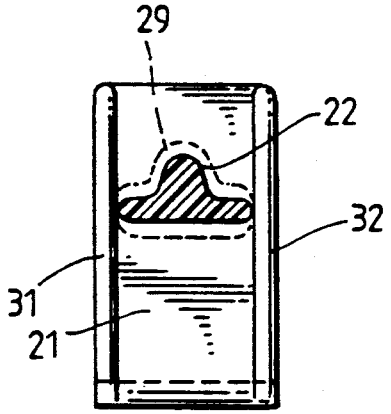
FIG. 5 shows a top view of part of the snow guard according to FIG. 4.

FIG. 5 shows a front view, partially cut away, of the snow guard according to FIG. 4. Vertical part 21 has reinforcing ribs 31 and 32 in the edge area.

Figure 6:
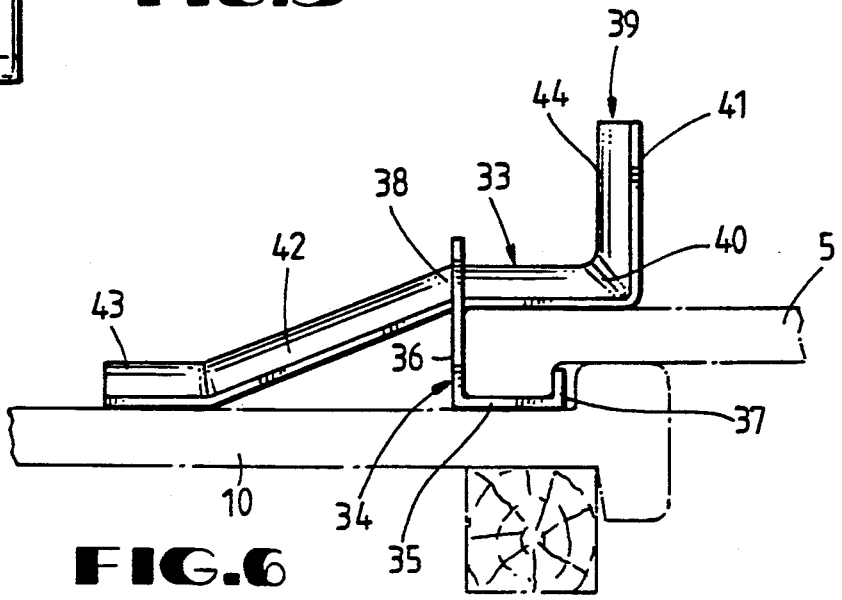
FIG. 6 shows a side view of a fourth practical example of the snow guard.

FIG. 6 shows a side view of a fourth practical example 33 of the snow guard. Snow guard 33 has a retaining strap 34 which comprises a horizontal part 35 resting on tile 10, a part 36 at right angles to the horizontal part, as well as a projection 37 bent at right angles at the end of part 35. Part 39, which is bent several times, passes through an opening 38 in part 36 and has a part 40 resting on tile 5, a snow retaining part 41 at right angles to the latter, as well as a part 42 that runs at an angle to part 40 and a part 43 that rests on tile 10 and is bent relative to part 42. A reinforcing rib 44 extends over parts 40, 41, 42, and 43. Strap 34 and part 39 are preferably made of metal but may also be made of plastic.

Figure 7:
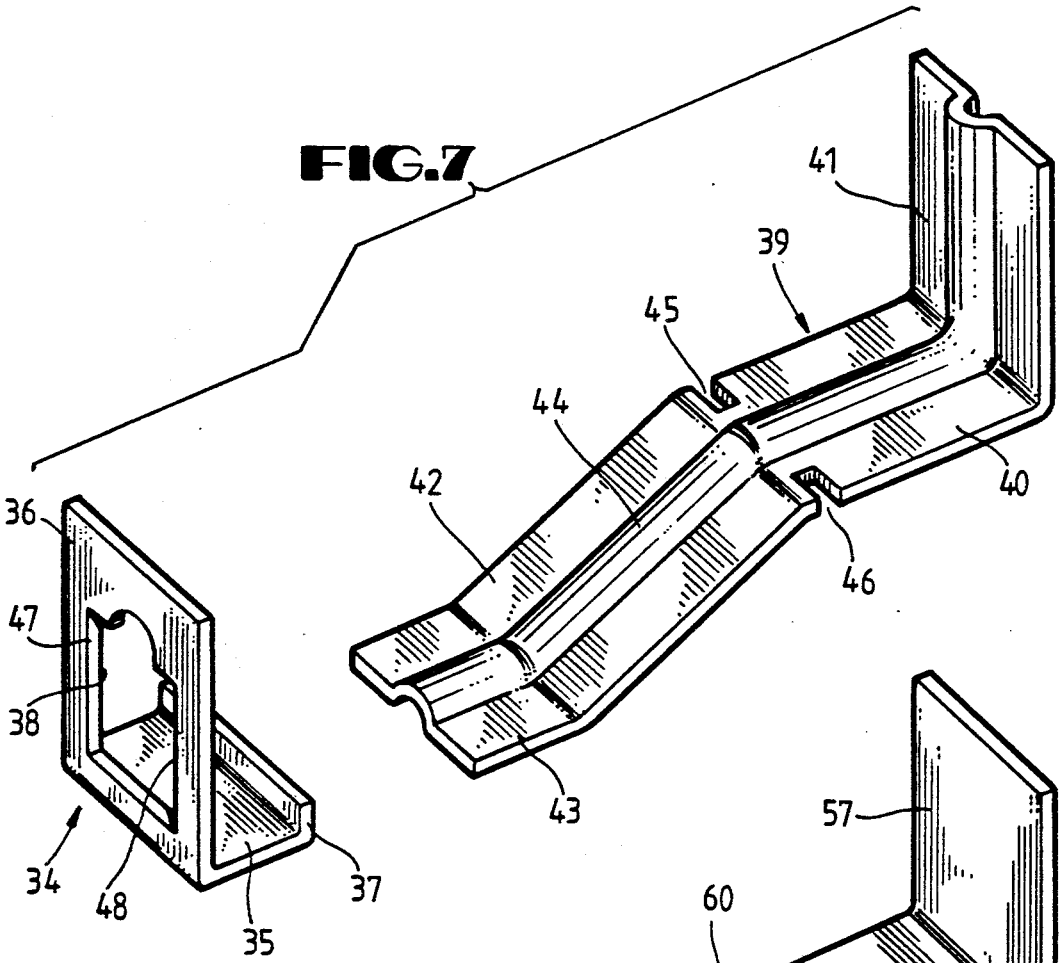
FIG. 7 shows a perspective view of the practical example according to FIG. 6.

FIG. 7 shows a perspective view of snow guard 33 according to FIG. 6, where part 39 is not in retaining strap 34. For a movable connection of the two parts 34 and 39, snow retaining part 39 is rotated by about 90° relative to the position shown in FIG. 7 and can be inserted through opening 38 into holding strap 34 and can be turned back about the same angle so that two grooves 45 and 46 become engaged with edge parts 47 and 48 of opening 38. As in the practical examples described previously, this snow guard is also suitable for roof tiles of different types and thicknesses. Horizontal part 35 of retaining strap 34 as well as horizontal part 40 likewise form a clamp around the lower end of roof tile 5.

Figure 8:
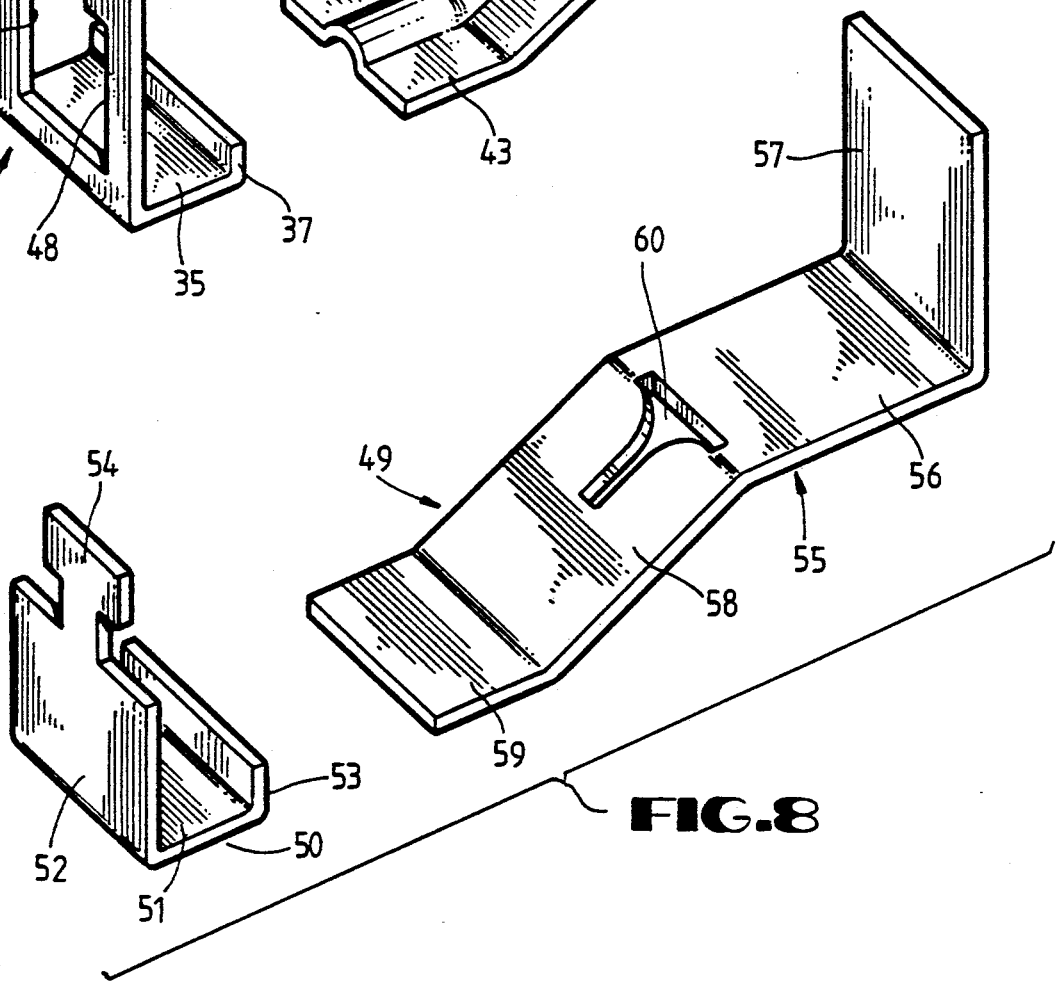
FIG. 8 shows a perspective view of a fifth practical example of the snow guard.

FIG. 8 shows a fifth practical example 49 of this snow guard. As in the version according to FIGS. 6 and 7, it comprises a holding strap 50 with a horizontal part 51, a vertical part 52 bent at right angles to the latter, as well as a projection 53 bent at right angles to the horizontal part 51. A T-shaped projection 54 is provided at the top of vertical part 52. Part 55 comprises a horizontal part 56, a snow retaining part 57 bent at right angles to the latter, a part 58 running obliquely to part 56, as well as a contact part 59 bent relative to part 58. In the area of parts 56 and 58, a T-shaped slit 60 is provided. For the purpose of movable mounting of parts 56 and 55 relative to each other, snow retaining part 55 is rotated 90° in comparison with the position illustrated in FIG. 8 so T-shaped slit 60 comes to rest over T-shaped projection 54. Snow retaining part 55 is then pushed down on the latter and again rotated 90°. Parts 51 and 56 likewise form a tong-like arrangement to hold the lower end of roof tile 5 which may vary in thickness and shape.

Figure 9:
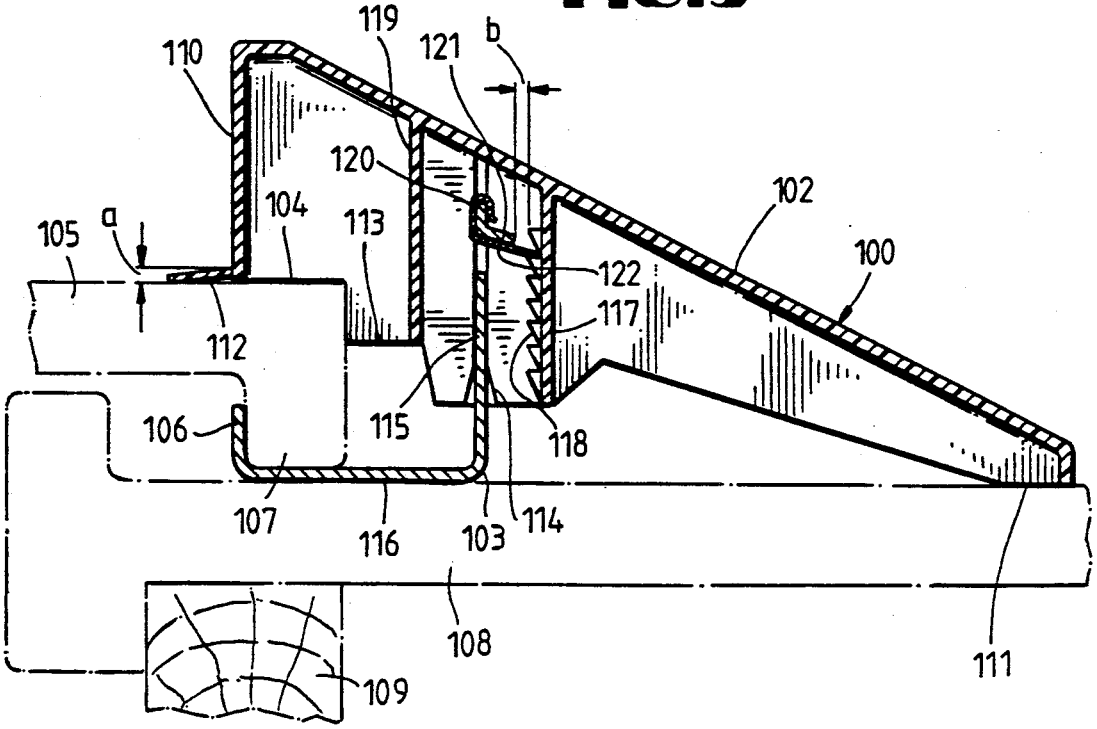
FIG. 9 shows a longitudinal section through a sixth practical example of a snow guard.

Snow guard 100 according to FIG. 9 has an integrated plastic part 102 and a retaining strap 103 made of metal and held in the plastic part so it can move and be locked in position. Plastic part 102 has a shoulder 104 resting against a clay tile 105 at the top. Metal strap 103 reaches with a projection 106 on the end around shoulder 107 at the lower end of clay tile 105. In addition, FIG. 9 also shows clay tile 108 lying at the bottom as well as a roof beam 109. Plastic part 102 of snow guard 100 has a snow retaining part 110 that sits on upper tile 105 and a part 111 that rests on lower tile 108. A nose 112 is flexibly connected to snow retaining part 110 on the lower end of snow retaining part 110 that rests on tile 105. Nose 112 projects downward at a slight angle where distance a is preferably about 2 mm. In addition, plastic part 102 has a shoulder 113 when using concrete tiles. Within part 102, there is a guide channel 114 to receive vertical part 115 of strap 103. Strap 103 sits with its horizontal part 116 on lower clay tile 108. In the area of guide part 114, there is a catch plate 117 with catch teeth 118. In addition, a vertical strut 119 is also provided. In the upper area 120 of vertical part 115 of strap 103, nose 121 is bent over and metal spring 122 is placed around the upper area 120 of strap 103 and the lower side of nose 121.

To secure snow guard 100 on tile 105, shoulder 104 is placed with nose 112 on the surface of tile 105, strap 103 is inserted into the guide channel until vertical part 116 of strap 103 rests on shoulder 107 of the tile at the bottom, and then plastic part 102 of snow guard 100 and strap 103 can be pressed together slightly due to flexible nose 112 until spring 122 locks between two catch teeth 118. The flexible arrangement of nose 112 also acts as a spacer. Then strap 103 cannot be removed from guide channel 114 or plastic part 102 because nose 121 in upper area 120 of vertical part 115 of strap 103 prevents spring 122 from bending upward. The distance b between nose 121 and catch teeth 118 is preferably about 1 to 1.5 mm. Shoulder 104 of part 102 of snow guard 100, horizontal part 116, and projection 106 of metal strap 103 engage the end of tile 105 like prongs. The greater the pressure of the snow on snow retaining part 110, the greater the clamping action of the prong-like parts of the snow guard, namely shoulder 104, horizontal part 116, and projection 106 of metal strap 103 on end 107 of tile 105. Due to the fact that contact part 111 of snow guard 100 sits securely on lower tile 108, snow retaining part 110 of snow guard 100 can hold extremely large snow loads. Snow on nose 112 also presses the snow guard onto tile 105.

Figure 10:
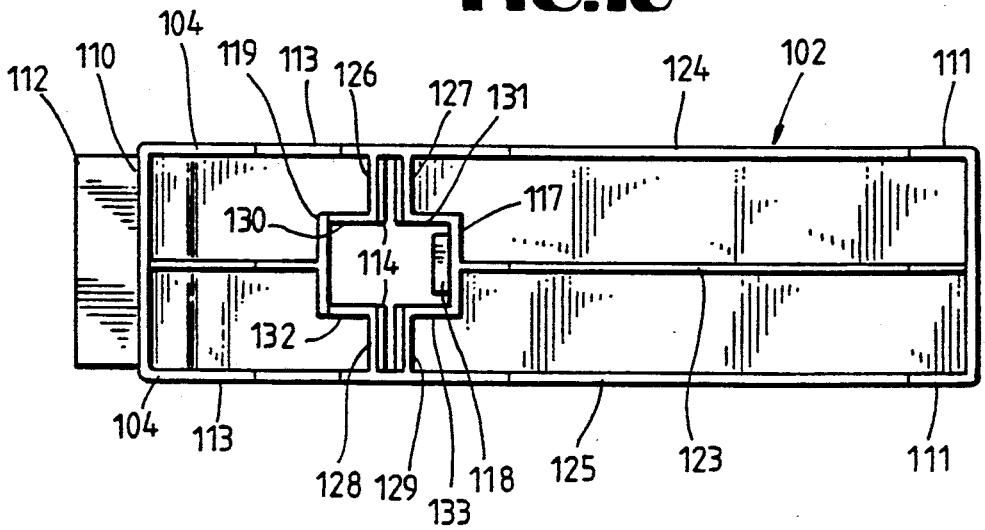
FIG. 10 shows a view of the practical example from FIG. 9 as seen from beneath.

FIG. 10 shows a view of the practical example according to FIG. 9 as seen from beneath. In addition to FIG. 9, this also shows a longitudinal reinforcing rib 123. Guide channel 114 for strap 103 includes vertical guide parts 126, 127, 128, and 129 that are next to side parts 124 and 125 of plastic part 102 and are connected to vertical strut 119 and catch plate 117 by way of webs 130, 131, 132, and 133.

Figure 11:
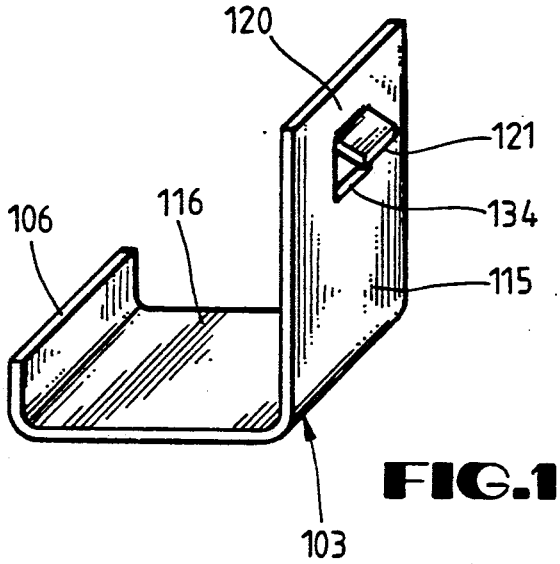
FIG. 11 shows a perspective view of the movable retaining strap according to the sixth practical example.

FIG. 11 shows a perspective view of retaining strap 103. In upper area 120 of vertical part 115 of retaining strap 103, a rectangular recess 134 has been provided with nose 121 bent down at its upper end. Nose 121 preferably forms an angle of about 80° with vertical part 115 of retaining strap 103.

Figure 12:
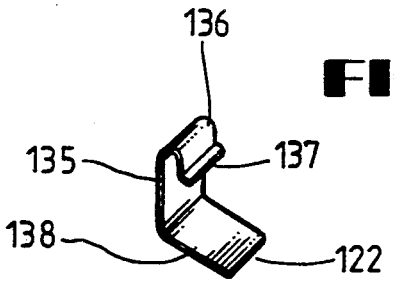
FIG. 12 shows a perspective view of the springs that can be inserted into the retaining strap according to FIG. 11.

FIG. 12 shows spring 122 in a perspective view where the spring is wrapped around upper area 120 of vertical part 115 of holding strap 103 and around the lower side of nose 121. The part of spring 122 wrapped around upper area 120 of strap 103 includes a vertical part 135, curved part 136, as well as bent part 137. Bent part 138, which is next to the bottom of nose 121, follows vertical part 135.

Figure 13:
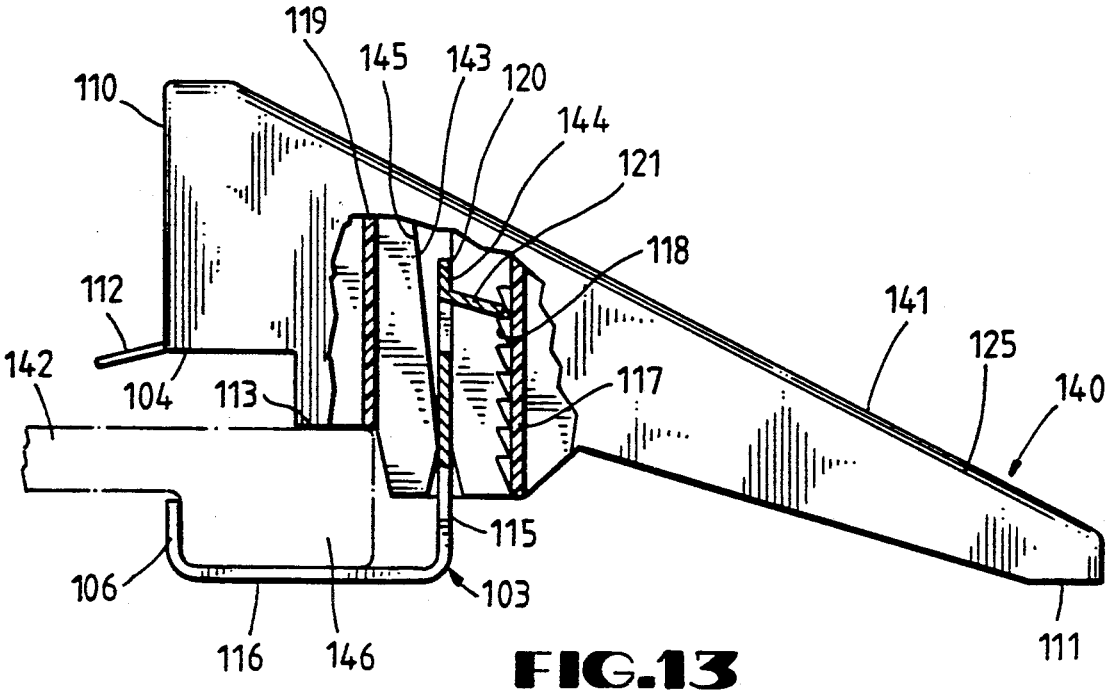
FIG. 13 shows a side view, partially a sectional view, of a seventh practical example of the snow guard.

FIG. 13 shows a side view with a partial cutaway view of a seventh practical example of snow guard 140. The same parts as in the sixth example are provided with the same reference numbers in this example. This example also includes integrated plastic part 141 as well as retaining strap 103. Retaining strap 103 likewise has vertical part 115, horizontal part 116, and projection 106 bent away from horizontal part 116. In this example, use of the snow guard with a concrete tile 142 is shown, where in this case shoulder 113 of plastic part 141, horizontal part 116, and projection 106 of retaining strap 103 hold the lower end 146 of the concrete roof tile as seen in the direction of the roof in the manner of prongs. The seventh example illustrated in FIG. 13 could, of course, also be used with clay tiles as illustrated in FIG. 9, in which case then shoulder 104 would rest on the tile. Plastic part 141 likewise includes catch plate 117 with catch teeth 118. Guide channel 143 for holding strap 103 has a first guide plate 144 running parallel to catch plate 117, as well as a second guide plate 145 at an angle to the latter. Upper area 120 as well as nose 121 of vertical part 115 of retaining strap 103 are not provided with any springs in this version. Retaining strap is inserted diagonally into guide channel 143 by resting it on guide plate 145, in which case it is pushed upward until shoulder 113 of plastic part 141, as well as horizontal part 116 of the retaining strap 103, grip end 146 of tile 142 like prongs and then is titled and shifted further upward if necessary until nose 121 engages between two catch teeth 118. Likewise, as in the practical example according to FIGS. 9–12, it is also true with this practical example that the clamping effect on tile 142 of the snow guard holding tile end 146 like prongs is greater as the pressure of the snow on snow retaining part 110 increases (i.e., shoulder 113 and horizontal part 116 and projection 106 of retaining strap 103).

All the versions according to FIGS. 1–13 have the advantage that they can be used for roof tiles of any shapes and thicknesses.

The snow guard according to this invention can be used for clay tiles having a greater thickness but a somewhat narrower shoulder 107 at the end or for concrete tiles having a smaller thickness but a somewhat wider shoulder 143 at the end as illustrated in FIGS. 9 and 10. This is achieved by providing two shoulders 104 and 113 on snow retaining part 110.

In all versions of this invention, the arms forming the prongs are pressed together by the pressure of the snow acting on the snow retaining part and in doing so are held securely on the roof tile.

In a version not shown in the figure, the snow retaining part is arranged in the area of the part resting on the next tile.

What is claimed is:

1. A one piece snow guard adapted for use on tile roofs, comprising a snow retaining part and a bearing part, and two movable arms adapted for extending about an upper and lower surface of a roof tile and attaching thereto.

2. The snow guard according to claim 1, wherein the snow retaining part extends from one end of an arm and runs approximately at a right angle to it.

3. The snow guard according to claim 1, wherein one arm is provided with a projection for engaging with the end of the roof tile.

4. The snow guard according to claim 1, further comprising at least one reinforcing rib.

5. A one piece snow guard adapted for use on tile roofs, with a bearing part and a snow retaining part, comprising two movable arms intended for reaching around one end of a roof tile, where at least one arm is provided with holding devices for joining the arms detachably.

6. The snow guard according to claim 5, wherein one arm is part of a retaining strap that is equipped with an opening for passing the other arm through it, and the other arm is provided with a stop.

7. The snow guard according to claim 5, wherein one arm is part of a retaining strap and the part of the retaining strap running at right angles to said arm is provided with an opening, and the other arm is connected to snow retaining part at one end, and in the transition area to the bearing part it is provided with at least one groove for engaging in side walls of the opening in the retaining strap.

8. The snow guard according to claim 5, wherein one arm is part of a retaining strap, and the part of the retaining strap running at right angles to said arm is provided with a projection, and the other arm is connected at one end of snow retaining part, and in the transition area to the bearing it is provided with an opening for engaging in said projection on said part of the retaining strap that runs at right angles to said arm.

9. The snow guard according to claim 5, wherein the part of an arm forming a retaining strap is provided on one end with a projection intended for engaging the end of the roof tile.

10. The snow guard according to claims 1 or 5, wherein the snow retaining part is arranged in the area of the bearing part.

11. A one piece snow guard comprising a snow retaining part and a bearing part, as well as two elements intended for reaching around one end of a roof tile in the manner of prongs and designed so that they are movable relative to each other and can be locked together.

12. The snow guard according to claim 11, wherein the snow retaining part, bearing part, a first element intended for reaching around the end of the roof tile, a first device for holding the second element, as well as a second device for locking the second element, are designed as an integrated part.

13. The snow guard according to claim 11, wherein the second element is designed as a retaining strap with two bends, where the first bent part is intended for engaging in one end of a roof tile and its second bent is intended for insertion into the first device.

14. The snow guard according to claim 12, wherein the first device for receiving the second element is designed as a guide channel running obliquely to the catch plate.

15. The snow guard according to claim 11, wherein the first element is designed as at least one shoulder connected to snow retaining part.

16. The snow guard according to claim 11, wherein the snow retaining part is provided with a nose which projects away from it and is movable relative to it.

17. A snow guard for use with a roof tile, comprising:

a snow retaining part and a bearing part, as well as two elements intended for reaching around one end of a roof tile in opposing relationship and designed so they are movable relative to each other and can be locked together;

wherein the second element is designed as a retaining strap with two bends, where the first bent part is intended for engaging in one end of a roof tile and its second bent part is intended for insertion into the first element; and wherein the second bent part of the retaining strap is provided with a nose in its upper area.

18. The snow guard according to claim 17, wherein the nose forms an angle of about 80° with the second bent part.

19. A snow guard for use with a roof tile, comprising:

a snow retaining part and a bearing part, as well as two elements intended for reaching around one end of a roof tile in opposing relationship and designed so they are movable relative to each other and can be locked together;

wherein the second element is designed as a retaining strap with two bends, where the first bent part is intended for engaging in one end of a roof tile and its second bent part is intended for insertion into the first element; and wherein the retaining strap is provided with a spring in its upper area so the spring reaches around a lower side of a nose in its upper area.

20. A snow guard for use with a roof tile, comprising:

a snow retaining part and a bearing part, as well as two elements intended for reaching around one end of a roof tile in opposing relationship and designed so they are movable relative to each other and can be locked together;

wherein the snow retaining part, bearing part, a first element intended for reaching around the end of the roof tile, a first device for holding the second element, as well as a second device for locking the second element are designed as an integrated part; and, wherein the second device for locking the snow retaining part in said integrated part is designed as a catch plate.

* * * * *

UNITED STATES PATENT AND TRADEMARK OFFICE

CERTIFICATE OF CORRECTION

PATENT NO. : 5,070,660

DATED : December 10, 1991

INVENTOR(S) : Siegfried Willa

It is certified that error appears in the above—identified patent and that said Letters Patent is hereby corrected as shown below:

Column 6, line 41, after "bent" insert -- part --.

Signed and Sealed this

Thirtieth Day of March, 1993

*Attest:*

STEPHEN G. KUNIN

*Attesting Officer*

*Acting Commissioner of Patents and Trademarks*